US009627159B2

(12) United States Patent
Teoh et al.

(10) Patent No.: US 9,627,159 B2
(45) Date of Patent: Apr. 18, 2017

(54) METHOD AND APPARATUS FOR PROVIDING SLIDE ACTUATION ON A DEVICE

(71) Applicant: MOTOROLA SOLUTIONS, INC, Schaumburg, IL (US)

(72) Inventors: Wooi Ping Teoh, Georgetown (MY); Weng Kong Hor, Butterworth (MY); Weng Wai Koh, Bukit Mertajam (MY); Lee Sun Ooi, Kulim (MY)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 103 days.

(21) Appl. No.: 14/519,828

(22) Filed: Oct. 21, 2014

(65) Prior Publication Data

US 2016/0111233 A1 Apr. 21, 2016

(51) Int. Cl.
*H01H 15/10* (2006.01)
*H01H 15/04* (2006.01)
*H01H 15/00* (2006.01)

(52) U.S. Cl.
CPC ..... *H01H 15/04* (2013.01); *H01H 15/005* (2013.01); *H01H 15/102* (2013.01)

(58) Field of Classification Search
CPC .. H01H 3/00; H01H 3/02; H01H 3/04; H01H 3/12; H01H 15/00; H01H 15/005; H01H 15/02; H01H 15/04; H01H 15/06; H01H 15/10; H01H 15/16; H01H 15/24
USPC ..... 200/502, 5 R, 5 EA, 537, 547, 549, 550, 200/16 E, 178, 51 R, 51.02, 531, 563, 200/252, 241; 439/188, 66
See application file for complete search history.

(56) References Cited

U.S. PATENT DOCUMENTS 2,966,560 A * 12/1960 Gluck ..... H01H 15/06 200/16 C
3,806,673 A * 4/1974 Boulanger ..... G06C 7/02 200/17 R
4,277,663 A * 7/1981 Soes ..... H01H 1/24 200/16 R
4,316,067 A 2/1982 Whiteman, Jr.
4,454,391 A * 6/1984 Olsson ..... H01H 15/005 200/16 D (Continued)

FOREIGN PATENT DOCUMENTS

AU 2011316590 A1 4/2012
WO 2008154611 A2 12/2008

OTHER PUBLICATIONS

500 R Series Slide Switch Dated Sep. 2014.

*Primary Examiner* — Anthony R. Jimenez

(57) ABSTRACT

A slide actuation apparatus includes a bezel configured to maintain a configuration of the slide actuation apparatus. The bezel also includes an opening on an external surface. The slide actuation apparatus also includes an actuator configured to move within a compartment formed by the opening and a sliding rail configured to guide movements of the actuator along a surface of the sliding rail. The sliding rail is compressible downward in response to movement of the actuator along the surface of the sliding rail. The slide actuation apparatus further includes a slide contact configured to make an electrical connection to a flexible circuit and configured to provide a signal of a change to a circuit board of an attached computing device in response to downward compression of the sliding rail.

17 Claims, 6 Drawing Sheets

(56) References Cited

U.S. PATENT DOCUMENTS

| | | | | |
|---|---|---|---|---|
| 5,147,990 | A | 9/1992 | Dionisio, Jr. et al. | |
| 5,977,499 | A * | 11/1999 | Black | H01H 15/005 200/16 D |
| 6,657,316 | B1 * | 12/2003 | Smith | B60J 7/0573 307/10.1 |
| 8,440,922 | B2 | 5/2013 | Yeates et al. | |
| 8,466,384 | B2 | 6/2013 | Villain | |
| 2012/0194317 | A1 | 8/2012 | Vranicar et al. | |

* cited by examiner

METHOD AND APPARATUS FOR PROVIDING SLIDE ACTUATION ON A DEVICE

BACKGROUND OF THE INVENTION

A radio can be configured to be a member of one or more groups of radios (each of which is referred to herein as a talk group), wherein a single radio may transmit information that is simultaneously received by other members of the talk group. Each talk group is assigned to a specific frequency channel. As such, switching mechanisms are typically provided on mobile and portable radios to toggle between two different channels or functions.

A typical sliding switch mechanism may be used to switch between two channels or functions and may include a switch body, an actuator, a locking screw nut, a gasket, terminals and a connector. Most sliding switch mechanisms do not meet ratings set by the IP67 standard, i.e., a standard that classifies and rates the degree of protection provided against dust and water by mechanical casings and electrical enclosures. To comply with the IP67 standard, additional components may be added to the typical sliding switch mechanism. However, the added components typically increase the design cost and form factor of the sliding switch mechanism, and typically result in a relatively bulky switching mechanism.

As an alternative to the sliding switch mechanism, a rotary switch mechanism may be used to switch between two or more channels or functions. However, sliding switches offer advantages over rotary switches. For example, a sliding switch may be used to promote better user interaction in that a user of the sliding switch is allowed to toggle between only two channel or functions; the sliding switch may reduce risks associated with accidental actuation; and the sliding switch may allow for one-hand operations (for example, the sliding switch may enable the user to hold, for example, a mobile or portable radio, on which the switch is located and change the channel at the same time). Despite these benefits, a primary challenge of incorporating a sliding switch on devices such as mobile or portable radios is the space constraint at a top control compartment of the device.

Accordingly, there is a need for method and apparatus for providing sliding actuation on a device.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
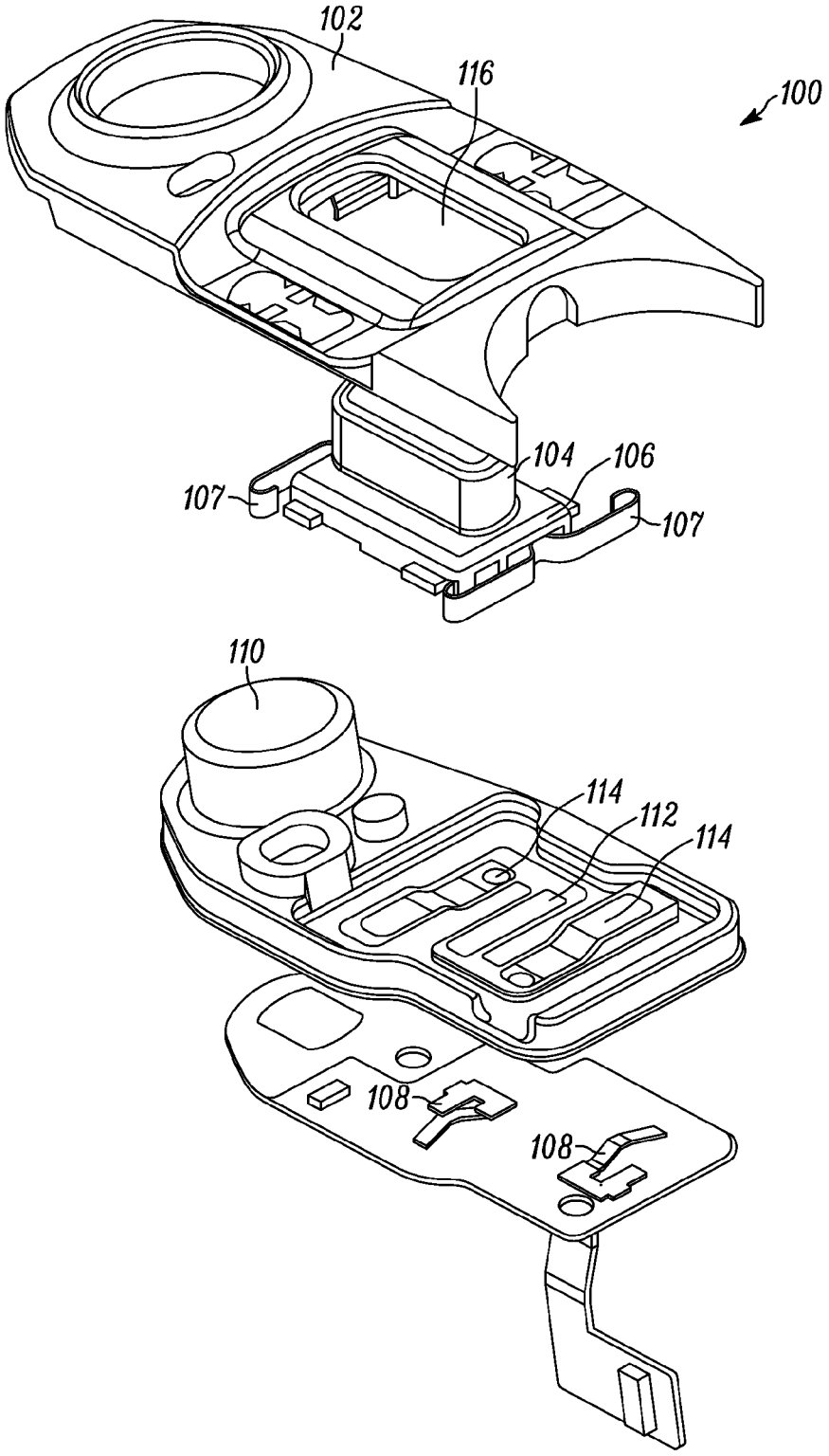
FIG. 1 is a block diagram of a configuration of a slide actuation apparatus used in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Some embodiments are directed to apparatus and method for providing sliding actuation. A slide actuation apparatus includes a bezel configured to maintain a configuration of the slide actuation apparatus. The bezel also includes an opening on an external surface. The slide actuation apparatus also includes an actuator configured to move within a compartment formed by the opening and a sliding rail configured to guide movements of the actuator along a surface of the sliding rail. The sliding rail is compressible downward in response to movement of the actuator along the surface of the sliding rail. The slide actuation apparatus further includes a slide contact configured to make an electrical connection to a flexible circuit and configured to provide a signal of a change to a circuit board of an attached computing device in response to downward compression of the sliding rail.

FIG. 1 is a block diagram of a configuration of a slide actuation apparatus used in accordance with some embodiments. Non-limiting examples of computing devices in which slide actuation apparatus 100 may be housed or attached may include a mobile radio or a portable radio. Although slide actuation apparatus 100 is shown as being housed on a top portion of the device, the slide actuation apparatus may be housed on other surfaces of the computing device and still fall within the scope of this disclosure. Slide actuation apparatus 100 may be attached to the housing of the computing device to enable the computing device to switch, for example, between two frequency channels or functions.

Slide actuation apparatus 100 includes a top bezel 102, an actuator 104, a sliding interface 106 with omega springs 107, a slide contact 108, a keypad 110, a sheet metal 112 and a sliding rail 114. Bezel 102 is configured to maintain the configuration of slide actuation apparatus 100. Bezel 102 may be attached to a front and/or top housing of the computing device by ultrasonic welding or other bonding techniques (for example, screws). Bezel 102 is also configured to include an opening 116 to allow actuator 104 to move within a compartment formed by opening 116. The opening 116 in bezel 102 is to prevent over-travel of actuator 104, thereby defining a travel distance (i.e., a space through which actuator 104 can be moved to switch the computing device from one channel/function to another channel/function). The travel distance is configured to prevent under over-movement or under-movement of actuator 104 during a switching operation.

Slide actuation apparatus 100 is configured to enable actuator 104 to be moved on sliding rails 114. Actuator 104 includes protruded edges (also referred to herein as plungers or indentations) for producing an actuation force or feedback force or "click" feeling when actuator 104 is pushed over the travel distance on sliding interface 106, positioned adjacent to actuator 104. The sliding interface 106 maintains the sliding direction of actuator 104 in a straight line and provides a fix travel distance for toggling the slide actuation apparatus to change from the first channel/function to the second channel/function.

Sliding interface 106 includes at least one omega spring 107 that is configured with at least one indentation, wherein in response to movement of the actuator along the surface of the sliding rail 114, at least one indentation/plunger on the actuator 104 is configured to overlap with at least one indentation on omega spring 107 and produce an actuation force. The travel distance over which actuator 104 can be moved to switch the computing device from one channel/function to another channel/function is configured to ensure that a user of the computing device can feel a change when the switch is made.

Sliding Rail 114 is provided by co-molding a keypad 110 with a sheet metal 112. In an embodiment, sheet metal 112 may be co-molded to the top of keypad 110. Sliding rail 114 provides an interface for sliding actuator 104. In an embodiment, keypad 110 may be a silicon rubber keypad for providing, for example, water and/or dust protection in accordance with the IP67 standard. For example, keypad 110 may be used to protect at least one component of slide actuation apparatus from water and/or dust in accordance with the IP67 standard. Although keypad is described and also referred to herein as being a rubber keypad 110, the material used for keypad 110 may include one or more materials in addition to or other than rubber.

Slide contact 108 includes a spring contact for making an electrical connection to a flexible circuit board and for providing a signal of a channel/function change to a main printed circuit board (PCB) in the device. The spring contact may be soldered onto the flexible circuit board. For example, the spring contact may be soldered to a top portion of the flexible circuit. The spring contact may also be configured to react with or connect to a contact terminal on the flexible circuit board to complete an electrical connection and provide signal to the main PCB for triggering a channel/function change. Permanent contact may be activated when the spring contact is compressed by actuator 104, as described in more detail below.

As noted previously, the rubber keypad 110 protects component of the slide actuation mechanism, for example, the flexible circuit board in accordance with the IP67 standard. In addition, the rubber keypad 110 provides flexibility for compressing sliding rail 114 downward to touch the spring contact when actuator 104 is pushed over the travel distance on the sliding interface 106.

Figure 2:
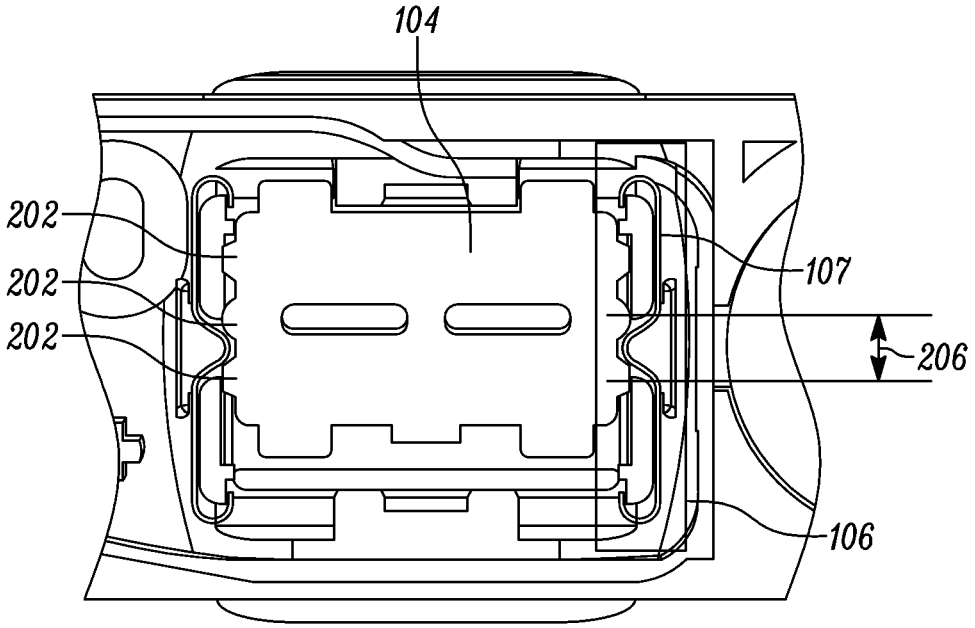
FIG. 2 is a top view of the slide actuation apparatus used in accordance with some embodiments.

FIG. 2 is a top view of the slide actuation apparatus used in accordance with some embodiments. Considering FIG. 2 with FIG. 1,-omega spring 107 may include indentations 202, wherein during sliding action, when plungers on actuator 104 overlaps with indentations 202, an actuation force or "clicking" feeling is produced. When actuator 104 is pushed/moved along sliding interface 106 from one end of the sliding rail 114 to the other end of the sliding rail 114 (shown as travel distance 206), sheet metal 112 may be compressed downwards on slide contact 108. The compressed spring contact on slide contact 108 forms a close loop to the flexible circuit board and provides a signal to the main PCB for indicating that the slide actuation apparatus 100 has been toggled to change, for example, from a first channel to a second channel.

Figure 3:
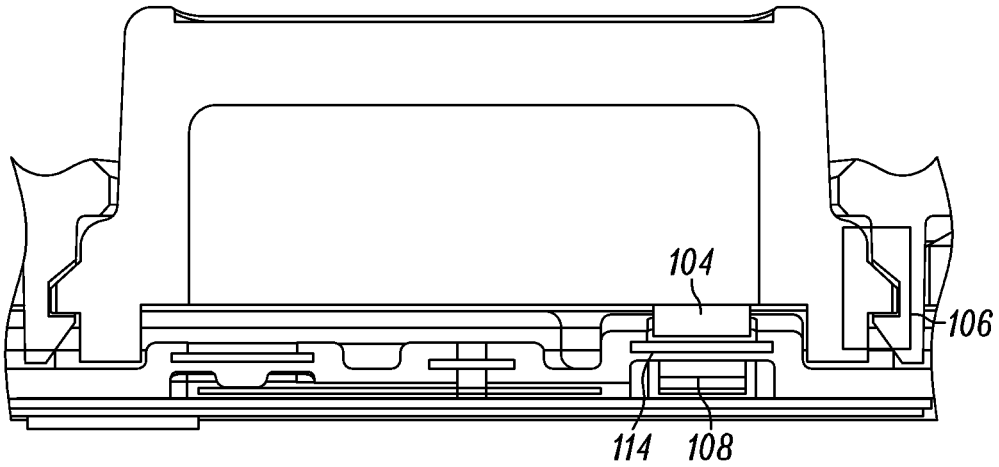
FIG. 3 is a front view of the slide actuation apparatus used in accordance with some embodiments.

FIG. 3 is a front view of the slide actuation apparatus used in accordance with some embodiments. Actuator 104 sits on top of a sliding rail 114 (i.e., sheet metal 112 co-molded with the rubber keypad 110). The sliding interface 106 maintains and facilitates the sliding direction in a straight line and provides a fix travel distance for toggling the slide actuation apparatus to change from the first channel/function to the second channel/function.

Figure 4:
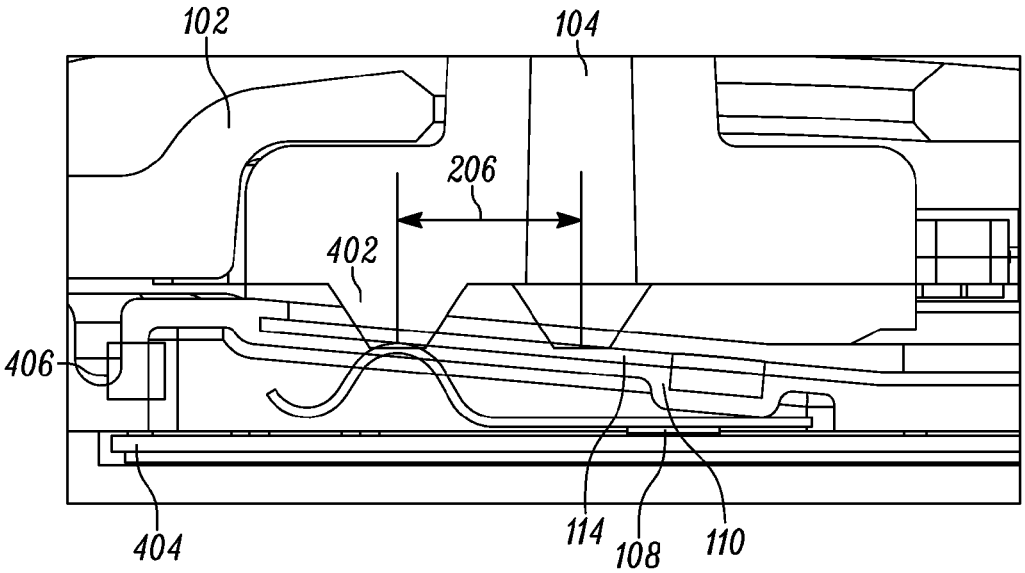
FIG. 4 is a side view of the slide actuation apparatus used in accordance with some embodiments.

FIG. 4 is a side view of the slide actuation apparatus used in accordance with some embodiments. During slide action, when a plunger 402 slides on the surface of sliding rail 114, sliding rail 114 may be compressed downwards on to the rubber keypad 110 which will simultaneously compress on slide contact 108. The compressed slide contact 108 compresses downward to flexible printed circuit 404 to form a close loop and provide a signal to the main PCB for indicating that the slide actuation apparatus has been toggled to switch channels/functions. A rubber web 406 which is part of the rubber keypad 110 may be used in an embodiment in order to provide flexibility during downward compression of the sliding surface so that sheet metal 112 may touch slide contact 108 during the downward compression. In other word, rubber web 406 is configured to flexibly compress sliding rail 114 downward to touch slide contact 108 in response to movement of actuator 104 along the surface of the sliding rail 114.

Figure 5:
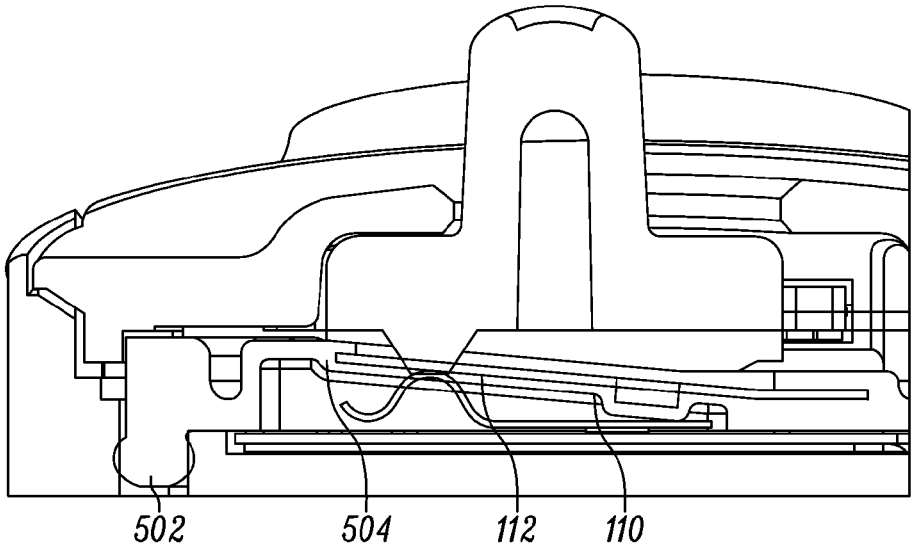
FIG. 5 is a further side view of the slide actuation apparatus used in accordance with some embodiments.

FIG. 5 is a further side view of the slide actuation apparatus used in accordance with some embodiments. The rubber keypad 110 is also used to protect the device from water and dust intrusion. In an embodiment, a primary seal 502 is formed by rubber keypad 110. In an embodiment, the primary seal 502 is designed in a mushroom shape to provide compression with a front housing grove. A secondary seal 504 is formed by the co-molding between the sheet metal 112 and the rubber keypad 110. Both seals are provided to comply with the IP67 standard. For example, seals 502 and 504 may be used to protect the components of the slide actuation apparatus from dust and water.

Figure 6A:
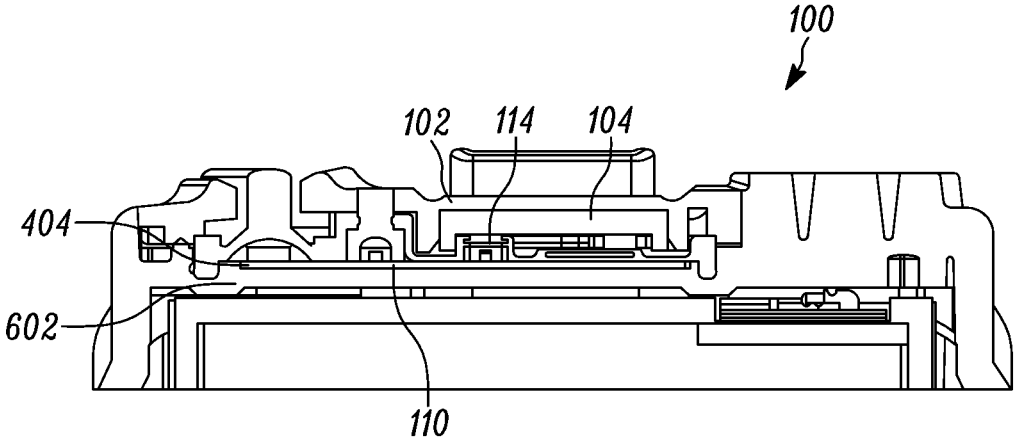
FIGS. 6A and 6B are overall views of the slide actuation apparatus used in accordance with some embodiments.
Figure 6B:
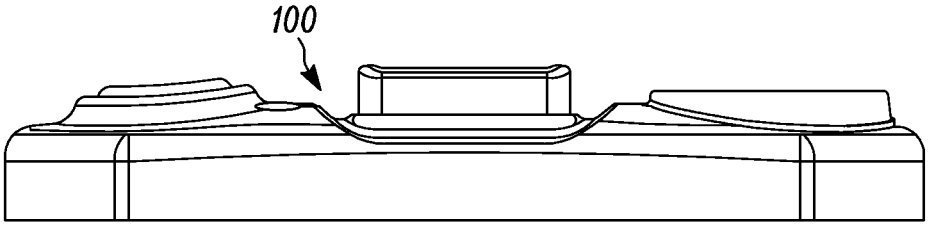

FIGS. 6A and 6B are overall views of the slide actuation apparatus used in accordance with some embodiments. In FIG. 6A, the configuration of the slide actuation apparatus 100 includes a 0.6 mm bezel 102, a 0.1 mm gap between bezel 102 and a 2.2 mm actuator 104 located under an internal surface of bezel 102, a 0.2 mm sliding rail 114 underneath actuator 104, a 0.4 mm rubber keypad/base 110 under sliding rail 114, a 0.3 mm flexible circuit 404 and adhesive and a 1.2 mm plastic base 602 that is attachable to the housing of the device. The overall dimension of the slide actuation apparatus 100 may be approximately five to six millimeters (5-6 mm), as shown in FIG. 6B. It should be noted that other dimensions may be used on the components in the slide actuation mechanism. The dimensions provided above are only provided to show that the slide actuation apparatus may be of a relatively small form.

Figure 7A:
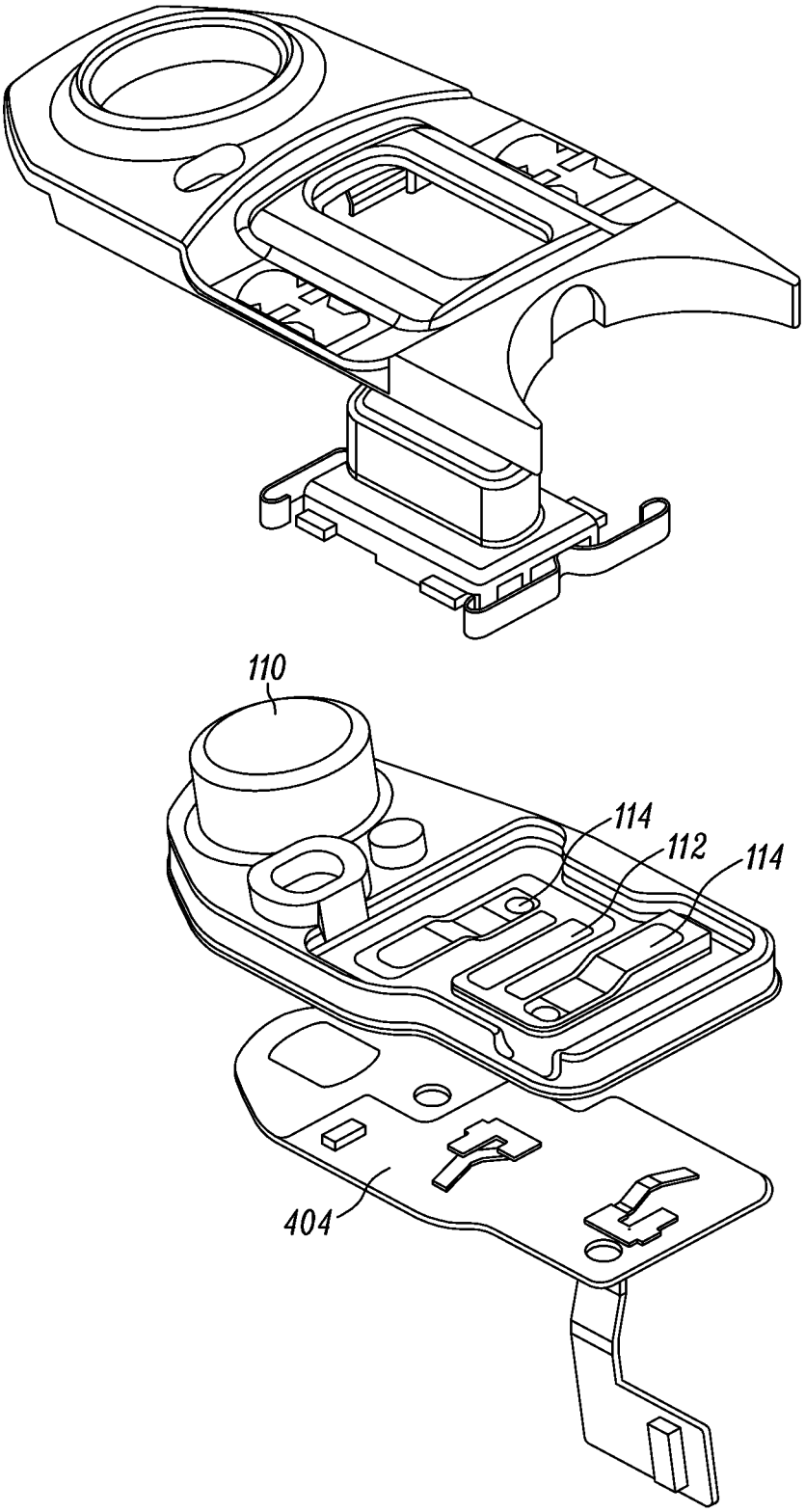
FIGS. 7A and 7B are diagrams of the slide actuation apparatus used in accordance with some embodiments.
Figure 7B:
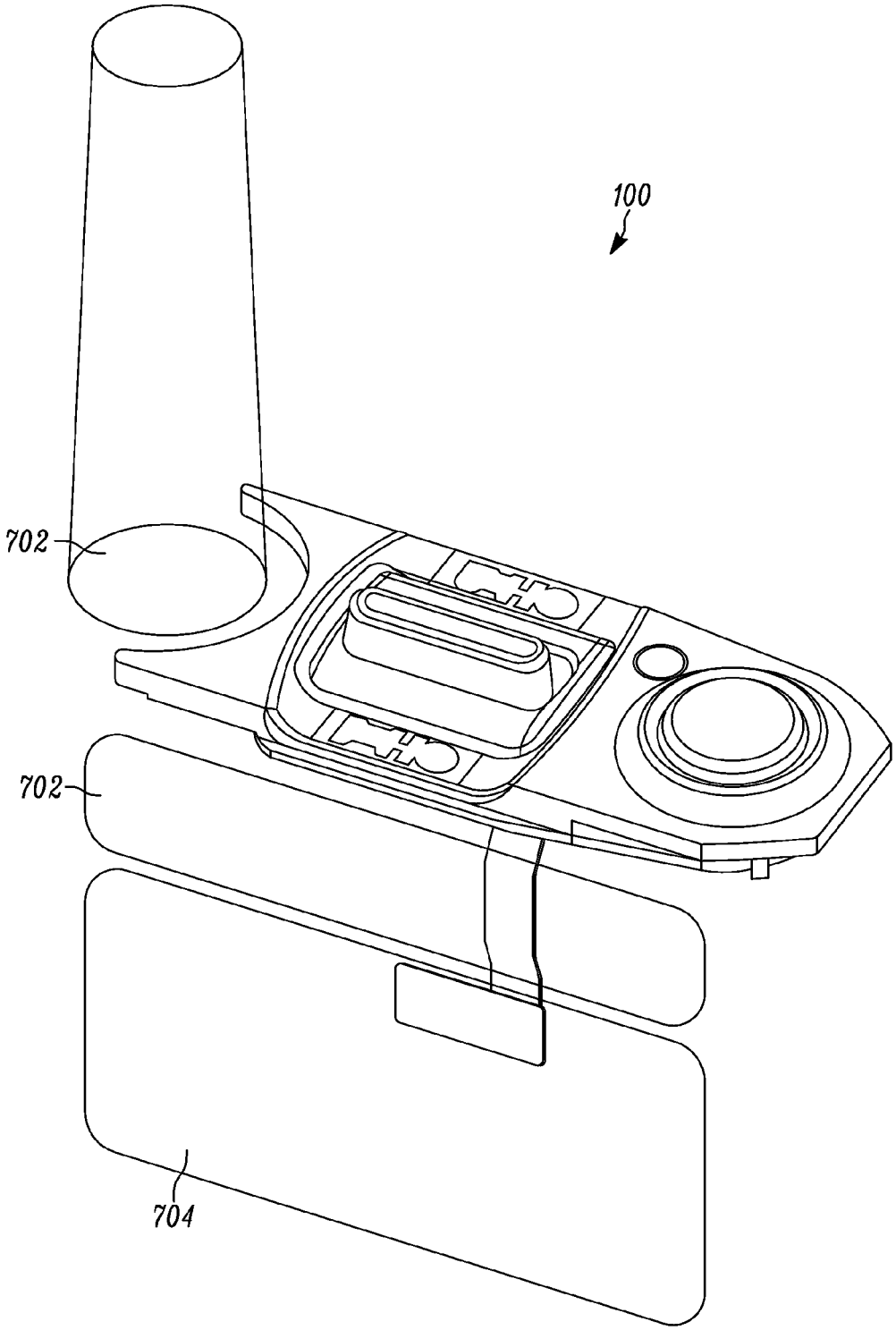

FIGS. 7A and 7B are diagrams of the slide actuation apparatus used in accordance with some embodiments. An embodiment of the invention seeks to minimize the amount metal element on the slide actuation apparatus to enable antenna construction around the slide actuation apparatus. This will reduce interference between the antenna and the metal element. As shown in FIG. 7A, metal elements are limited to sheet metal 112, sliding rail 114 and flexible circuit board 404. The flexible circuit board 404 is designed to have minimum metal element to enable an internal antenna construction, wherein the slide actuation apparatus is connected to a main PCB through the flexible circuit board 404 and a connector. FIG. 7B shows how a typical antenna element 702 is configured with the slide actuation apparatus 100. A main circuit board in the device 704 and slide actuation apparatus 100 may be designed as separate entities to provide flexibility in constructing antenna 702.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A slide actuation apparatus, comprising:

a bezel configured to maintain a configuration of the slide actuation apparatus and including an opening on an external surface;

an actuator configured to move within a compartment formed by the opening, the actuator having a plunger formed thereon;

a sliding rail configured to guide movements of the actuator along a surface of the sliding rail and compressible downward in response to movement of the actuator plunger along the surface of the sliding rail; and a slide contact configured to make an electrical connection to a flexible circuit and configured to provide a signal of a change to a circuit board of a computing device attached to the slide actuation apparatus in response to downward compression of the sliding rail, wherein the sliding rail includes a keypad co-molded with a sheet metal and the sliding rail is configured to maintain and facilitate a sliding direction of the actuator along the surface of the sliding rail; and wherein the keypad comprises a rubber web configured to flexibly compress the sliding rail downward to touch the slide contact in response to movement of the actuator along the surface of the sliding rail.

2. The slide actuation apparatus of claim 1, wherein the actuator includes indentations for producing a feedback force in response to movement of the actuator over a travel distance along the surface of the sliding rail.

3. The slide actuation apparatus of claim 1, wherein the bezel is configured to be attached to a housing of the computing device.

4. The slide actuation apparatus of claim 1, wherein the opening is configured to prevent over-travel of the actuator along the surface of the sliding rail.

5. The slide actuation apparatus of claim 1, wherein the slide contact includes a spring contact for making the electrical connection to the flexible circuit in response to downward compression of the sliding rail.

6. The slide actuation apparatus of claim 5, wherein the spring contact is soldered onto a top portion of the flexible circuit and, when compressed downward in response to movement of the actuator along the surface of the sliding rail, the spring contact is configured to react with a contact terminal on the flexible circuit to complete the electrical connection and provide the signal.

7. A slide actuation apparatus, comprising:

a bezel configured to maintain a configuration of the slide actuation apparatus and including an opening on an external surface;

an actuator configured to move within a compartment formed by the opening, the actuator having a plunger formed thereon;

a sliding rail configured to guide movements of the actuator along a surface of the sliding rail and compressible downward in response to movement of the actuator plunger along the surface of the sliding rail; and a slide contact configured to make an electrical connection to a flexible circuit and configured to provide a signal of a change to a circuit board of a computing device attached to the slide actuation apparatus in response to downward compression of the sliding rail, the sliding rail includes a keypad co-molded with a sheet metal and the sliding rail is configured to maintain and facilitate a sliding direction of the actuator along the surface of the sliding rail, and the keypad is configured to protect at least one component of the slide actuation apparatus from at least one of water and dust.

8. A slide actuation apparatus, comprising:

a bezel configured to maintain a configuration of the slide actuation apparatus and including an opening on an external surface;

an actuator configured to move within a compartment formed by the opening, the actuator having a plunger formed thereon;

a sliding rail configured to guide movements of the actuator along a surface of the sliding rail and compressible downward in response to movement of the actuator plunger along the surface of the sliding rail; and a slide contact configured to make an electrical connection to a flexible circuit and configured to provide a signal of a change to a circuit board of a computing device attached to the slide actuation apparatus in response to downward compression of the sliding rail; and a sliding interface including an omega spring configured with at least one indentation, wherein in response to movement of the actuator plunger along the surface of the sliding rail, at least one indentation on the actuator is configured to overlap with the at least one indentation on the omega spring and produce an actuation force.

9. A slide actuation apparatus, comprising:

a configuration including:

a bezel including an opening on an external surface;

an actuator located under an internal surface of the bezel, wherein the actuator is configured to move within a compartment formed by the opening, the actuator having a plunger formed thereon;

a sliding rail located under the actuator and including a sheet metal co-molded to a top of a keypad, wherein a surface of the sheet metal is configured to guide movements of the actuator and wherein the keypad is compressible downward in response to movement of the actuator plunger along the surface;

a slide contact located under the sliding rail; and a flexible circuit located under the slide contact and configured to make an electrical connection in response to downward compression of the sliding rail, wherein the flexible circuit is configured to connect the slide actuation apparatus to a circuit board on a computing device.

10. The slide actuation apparatus of claim 9, wherein the configuration further comprises a gap between the bezel and the actuator.

11. The slide actuation apparatus of claim 9, wherein an overall dimension of the slide actuation apparatus is between five to six millimeters.

12. The slide actuation apparatus of claim 9, wherein the flexible circuit is configured to provide a signal of a change to the circuit board in response to movement of the actuator along the surface of the sliding rail.

13. The slide actuation apparatus of claim 9, wherein the slide contact includes a spring contact to react with a contact terminal on the flexible circuit to complete the electrical connection and provide a signal of a change to the flexible circuit, in response to the sliding rail being compressed downward.

14. The slide actuation apparatus of claim 9, wherein the bezel is attachable to a housing of the computing device.

15. The slide actuation apparatus of claim 9, wherein the keypad is a rubber keypad.

16. The slide actuation apparatus of claim 9, further comprising: a sliding interface including an omega spring configured with at least one indentation, wherein in response to movement of the actuator plunger along the surface of the sliding rail, at least one indentation on the actuator is configured to overlap with the at least one indentation on the omega spring and produce an actuation clicking feedback force.

17. The slide actuation apparatus of claim 9, wherein the actuator comprises a single actuator.

* * * * *